United States Patent [19]

Katagiri et al.

[11] 4,222,710

[45] Sep. 16, 1980

[54] AXIAL FLOW FAN HAVING AUXILIARY BLADE

[75] Inventors: Haruo Katagiri; Kenji Fujikake; Katsuhito Yamada, all of Nagoya, Japan

[73] Assignee: Kabushiki Kaisha Toyota Chuo Kenkyusho, Aichi-ken, Japan

[21] Appl. No.: 861,972

[22] Filed: Dec. 19, 1977

[30] Foreign Application Priority Data

Dec. 20, 1976 [JP] Japan ..... 51-153067*

[51] Int. Cl.[2] ..... F04D 29/38; F04D 29/58

[52] U.S. Cl. ..... 416/236 A; 123/41.49; 165/122; 415/213 C

[58] Field of Search ..... 416/93 R, 169 A, 175, 416/236 A; 415/210, 212 R, 213 C, 119; 123/41.49; 165/122

[56] References Cited

U.S. PATENT DOCUMENTS

| | | | |
|---|---|---|---|
| 1,041,913 | 10/1912 | Tyson | 416/236 A |
| 1,066,988 | 7/1913 | Boutwell | 416/236 A |
| 1,446,011 | 2/1923 | Jackson | 416/236 A |
| 1,834,888 | 12/1931 | Baughn | 416/236 A X |
| 3,193,185 | 7/1965 | Erwin et al. | 416/236 A X |
| 3,635,285 | 1/1972 | Davis | 123/41.49 X |
| 3,677,660 | 7/1972 | Taniguchi et al. | 415/172 |
| 3,776,363 | 12/1973 | Kuethe | 415/119 X |
| 3,800,866 | 4/1974 | Ireland et al. | 165/122 |
| 3,827,482 | 8/1974 | Pope | 416/236 X |
| 3,842,902 | 10/1974 | Poslusny | 415/172 A X |
| 3,937,189 | 2/1976 | Beck | 123/41.49 |
| 4,093,402 | 6/1978 | Van Holten | 416/236 A |
| 4,128,363 | 12/1978 | Fujikake et al. | 416/236 A |
| 4,130,378 | 12/1978 | Eichler | 416/175 |

FOREIGN PATENT DOCUMENTS

| | | | |
|---|---|---|---|
| 388459 | 1/1924 | Fed. Rep. of Germany | 416/236 A |
| 954033 | 12/1956 | Fed. Rep. of Germany | 416/236 |
| 2319832 | 10/1973 | Fed. Rep. of Germany | 416/236 A |
| 840543 | 7/1960 | United Kingdom | 416/236 A |

*Primary Examiner*—Everette A. Powell, Jr.
*Attorney, Agent, or Firm*—Oblon, Fisher, Spivak, McClelland & Maier

[57] ABSTRACT

An axial flow fan having an auxiliary blade wherein a hub member is rotatably supported and driven by a drive source, a plurality of blades are provided having a predetermined angle with respect to the rotational direction thereof and a predetermined width and height, the blades being radially provided on the hub member, and at least one auxiliary blade is disposed on at least one of a suction and pressure surface of the blades and extends beyond an end portion of a trailing edge thereof and substantially within a predetermined length in the width direction of the blade of the surface thereof, a leading edge of the auxiliary blade being positioned closer to an axis of the fan than a trailing edge of the auxiliary blade.

The axial flow fan having such an auxiliary blade increases the radial flow by the extending portion of the auxiliary blade.

26 Claims, 39 Drawing Figures

AXIAL FLOW FAN HAVING AUXILIARY BLADE

BACKGROUND OF THE INVENTION

1. Field of the Invention

This invention relates generally to an axial flow fan having at least one auxiliary blade.

2. Description of the Prior Art

Hitherto, an axial flow fan finds a wide application because it provides a large quantity of air flow despite its small size. The axial flow fans may be classified into two types, i.e., a so-called non-pressure, open type, such as a cooling fan or blower, in which a pressure resistance is not present on a suction side or a discharge side of the fan in the close vicinity thereof, and a pressure resistance type, such as an automotive radiator fan, oil cooler fan, or an air conditioning fan, in which there is some pressure resistance either on the suction side or the discharge side of the fan, or those fans which are used in a pressurized condition, such as in a ram airflow.

In either case, an identical design principle is incorporated therein. Accordingly, a non-pressure, open type fan is often used as a pressure resistance type fan, irrespective of the pattern of air streams, thus resulting in a lowered efficiency and a high noise level.

According to the axial flow fan of prior applications of the present inventors, when applied to non-pressure open type fans, the quantity of discharge air may be increased, due to centrifugal air streams created by an auxiliary blade provided therefor, as compared with a prior art non-pressure, open type cooling fan and blower which does not produce centrifugal air streams, and, in addition, air may be blown over a large range of an area.

In addition, according to such prior applications, when applied to a pressure resistance type fan, a high quantity of air stream, as well as high operational efficiency, may be achieved with an improved noise level, due to the centrifugal air streams, as compared with a prior art fan, which does not produce centrifugal air streams, and in which a pressure resistance is present either on a suction side or on a discharge side of the fan, or on both sides of the fan.

The inventors made a continued study on this subject, and by paying attention to the fact that the trailing edge of a fan blade contributes to an increase in the quantity of discharge air and efficiency, the inventors made the present invention by improving the fans of their prior applications.

SUMMARY OF THE INVENTION

It is accordingly an object of the present invention to provide an axial flow fan having an auxiliary blade which may increase the quantity of discharge air and its efficiency.

It is a further object of the present invention to provide an axial flow and a radial flow.

According to the present invention, there is provided an axial flow fan having an auxiliary blade in which there is provided at least one auxiliary blade having a length in the chord direction of a main fan blade, either on a suction or on a pressure surface of the fan blade, with one end of the auxiliary blade at the leading edge of the fan blade being positioned closer to an axis of the fan than the other end of the auxiliary blade at the trailing edge of the fan blade, the aforesaid axial flow fan being characterized in that the auxiliary fan blade is formed on the fan blade in a manner to extend outwards beyond the trailing edge of the fan blade.

BRIEF DESCRIPTION OF THE DRAWINGS

Other objects, features and attendant advantages of the present invention will be more fully appreciated as the same becomes better understood from the following detailed description, when considered in connection with the accompanying drawings, in which.

DETAILED DESCRIPTION OF THE ILLUSTRATED EMBODIMENTS

Figure 1A:
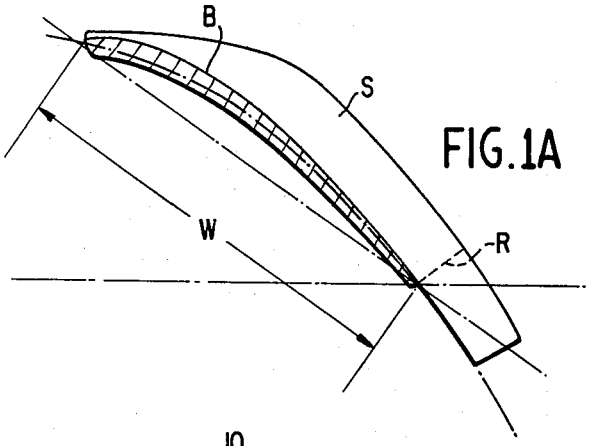
FIGS. 1A and 1B are views illustrative of an axial flow fan according to the present invention.

An axial flow fan having at least one auxiliary blade according to the present invention will now be described in more detail with reference to FIGS. 1A and 1B.

Figure 1B:
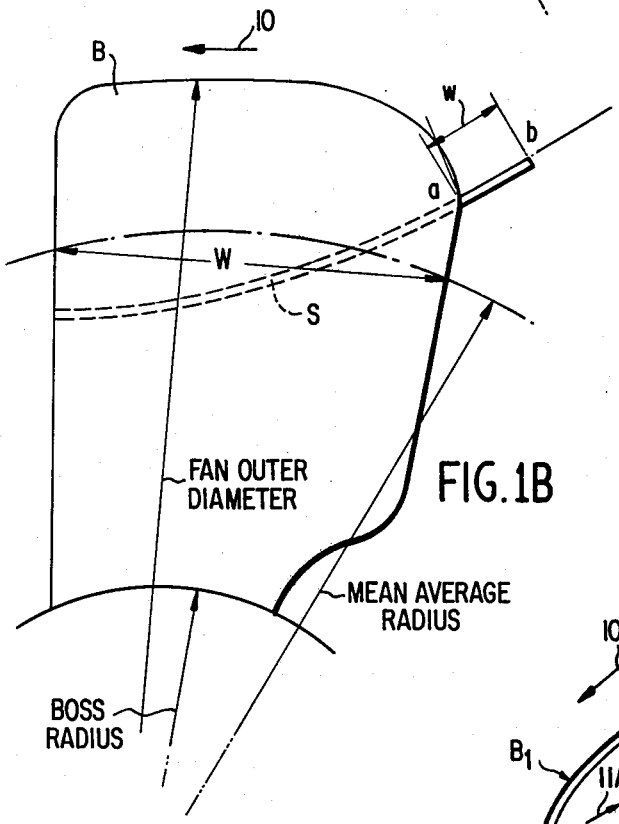

According to the axial flow fan having an auxiliary blade, as shown in FIG. 1B, an auxiliary blade S formed on a fan blade B projects from the trailing edge of the fan blade a distance w(ab) along its extension line, or a camber line. In contrast thereto, according to a prior art fan, as shown in FIG. 1A, an auxiliary blade S is formed on a concave or convex surface of a fan blade B (a convex surface is shown in FIG. 1A) and extends up to a position R therein, shown by a broken line. A chord length or width of the fan blade is shown at W, which represents a length of a chord of a blade from the leading edge to the trailing edge thereof, at a root mean square radius of the fan:

$$\left(\sqrt{\frac{(\text{fan outer diameter})^2 + (\text{boss radius})^2}{2}}\right).$$

With the axial flow fan according to the present invention, an auxiliary blade extends beyond the trailing edge of a fan blade rotating at a high peripheral speed during the operation, thereby creating centrifugal air streams with ease, with a resulting increase in the quantity of air being discharged and in its efficiency.

The features of the fan according to the present invention will be enumerated below:

(1) The auxiliary blade smoothly extends in the chord length (or width) direction of a fan blade beyond the trailing edge thereof or the radially outermost end of the fan blade, thereby providing an increased quantity of discharge air, without increasing the noise level;

(2) For providing strong centrifugal air streams by means of an auxiliary blade projecting from the trailing edge of the fan blade, the auxiliary blade projects from the trailing edge of the fan blade, thereby increasing the difference in the peripheral speed of air streams along the surface of the auxiliary blade, so that stronger air streams and an increased quantity of air streams may be blown outwards at a minimized pressure loss and with a high efficiency;

(3) Air may be blown outwards in the radial direction of the fan blade by means of an auxiliary blade projecting beyond the trailing edge thereof, so that the range for blowing air, i.e., the size of an object to which air is blown, may be increased, thus dispensing with a swinging action of the prior art cooling fan;

(4) Due to the auxiliary blade projecting beyond the trailing edge of the fan blade, the operating area of the fan blade for creating radial flow may be increased without increasing a load acting on the blade, with a resulting increase in the quantity of discharged air and without increasing the noise level; and (5) In case the fan according to the present invention is used in combination with a shroud, then a reverse flow from the discharge side to the intake side of the fan may be prevented by means of centrifugal air streams, so that the quantity of discharged air may be used effectively, with an increase in the quantity of intake air.

The axial flow fan according to the present invention will be described hereinafter in more detail with reference to further embodiments of the invention.

The first embodiment of an axial flow fan according to the invention is applied to an electric motor fan, i.e., a non-pressure, open type axial flow fan, as shown in FIGS. 2 to 5.

An axial flow fan F1, according to the first embodiment of the invention, is equipped with four fan blades B1 extending radially from an axis of rotation O. Provided on a pressure surface D1 of the fan blade is an auxiliary blade S, with a trailing edge 19B of the auxiliary blade S projecting out from the surface D1 of the fan blade into the wake, or into the rear region of the blade B1, and a chord length w of a projecting portion of the auxiliary blade corresponds to about 0.1W (13 mm), wherein w is defined as a linear length from the trailing edge of the fan blade to the extended trailing edge of the auxiliary blade, and W (130 mm) represents a chord length or width of the blade.

The leading end 19A of the auxiliary blade S is positioned on the side of a center of rotation of the fan with respect to the trailing end 19B thereof, and it is a common practice to provide a smooth curved surface between the ends 19A and 19B. In other words, a configuration of the aforesaid curved surface of the blade is commonly defined along air streams 11A, 11B flowing along the pressure surface D1 of a fan blade of the fan F1. The auxiliary blade S has a height of 10 mm in the thickness direction of the blade B1, and the trailing end 19B includes an end surface 19C extending along an extension line 21B extended to the rear region of a camber line 21A of the blade B1, while the end 19D has a face extending at a right angle to the extension 21B of the camber line. In this case, an angle formed by a line connecting the leading end 19A of the auxiliary blade to the trailing end 19B (a chord PQ of the auxiliary blade) and the direction of rotation of the blade B, i.e., an attaching angle $\theta$ of the auxiliary blade S, with respect to the direction of rotation of the auxiliary blade S, is generally selected as 5° to 45°. However, in this embodiment, the angle $\theta$ is selected as 10°.

Figure 2:
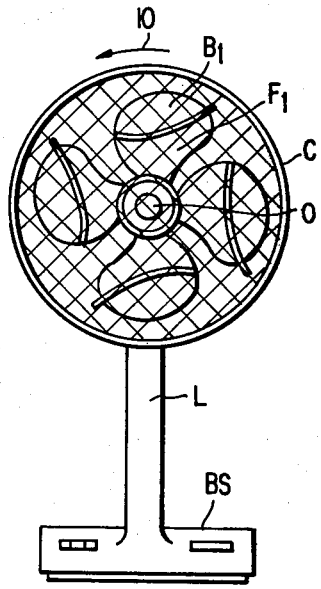
FIGS. 2 to 5 are views showing an axial flow fan according to a first embodiment of the present invention.
Figure 3:
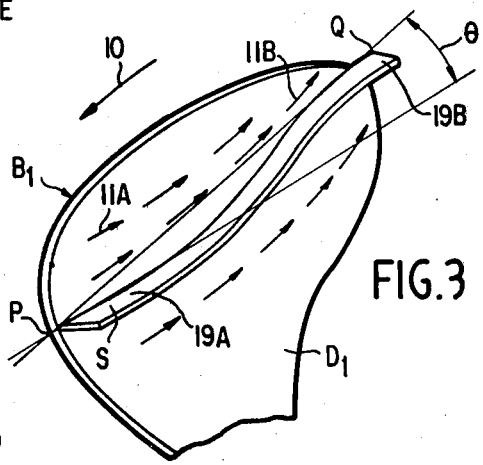
Figure 4:
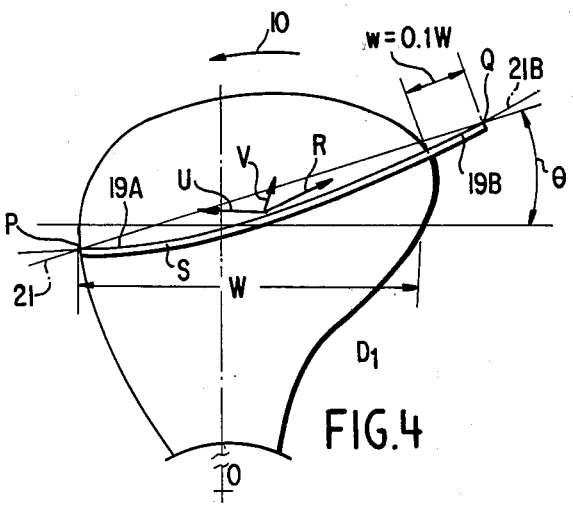
Figure 5:
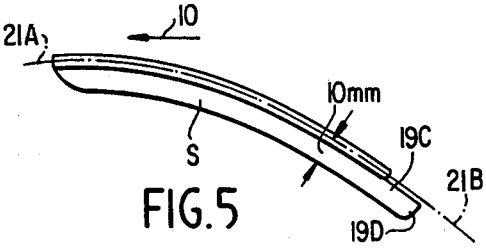
Figure 6:
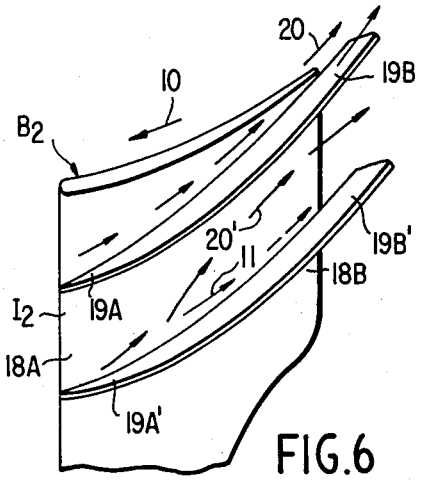
FIGS. 6 to 9 are views illustrative of axial flow fans according to a second embodiment of the present invention.
Figure 7:
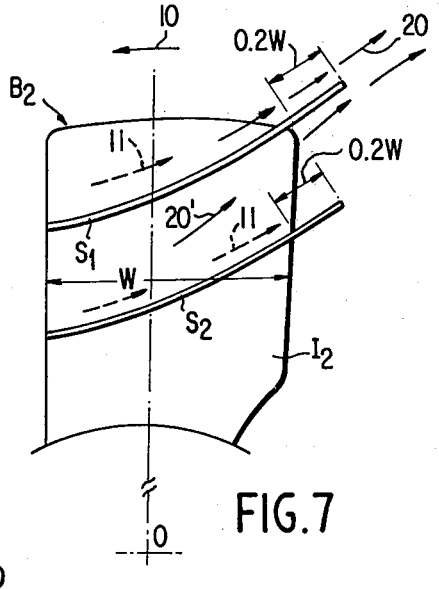
Figure 8:
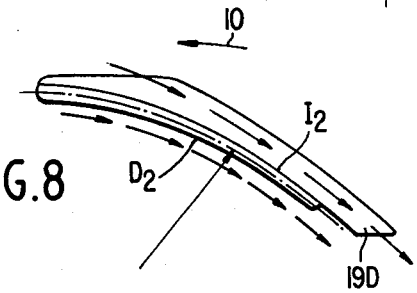

The fan blades B1 are rotatably positioned within a casing C of a shape similar to a bird cage and are rotated in the direction indicated by the arrow 10, as shown in FIG. 2, by means of a motor (not shown) positioned in the rear of the casing C. The casing C is supported on a leg portion L which is secured to a base BS incorporating a switch, adjusting knob, and electric power source cord.

The rotation of the fan F1 in the direction 10 in this embodiment creates air streams along the surface of the blade, as shown by an arrow 11, and other air streams are formed along the surface of the auxiliary blade S.

These air streams flow along the auxiliary blade, having a portion projecting from the trailing end of the fan blade, as mixed streams consisting of axial air streams and centrifugal air streams on the discharge side of the fan, with the result that the quantity of discharged air may be increased as compared with that of the prior art fan, with an accompanying increase in the range of air to be blown.

More particularly, the auxiliary blade S is provided on the surface of a fan blade in a manner not to hinder the smooth air flow along the surface of the fan blade, where a small centrifugal air flow is originally created. As a result, the axial flow fan according to the present invention may retain the axial air streams as obtained in the fan devoid of the auxiliary blade, and further provides an absolute velocity V consisting of a component of air streams R flowing along the surface of the auxiliary blade, and a peripheral speed U, so that the absolute velocity V is added to air streams in the form of a centrifugally discharged air stream 20, thereby increasing the quantity of discharged air as well as the range of air to be blown.

Particularly, the auxiliary blade S projects from the trailing edge of the fan blade, so that the surface area of the auxiliary blade may be increased, thus allowing maximization of the peripheral speed of the air flow. In addition, there arises a large difference in peripheral speed between the leading end 19A (inflow side) and the trailing end 19B (outflow side), so that the centrifugal air streams 20 may be rendered stronger than that obtained by the fan having an auxiliary blade as has been disclosed heretofore in previous patent applications, and, accordingly, the quantity of the discharged air may be increased.

Furthermore, the auxiliary blade S is formed along the air streams 11, so that there takes place neither separation of air streams from a blade surface, nor swirl of air, thus allowing centrifugal air streams 20 to be created without increasing the noise level.

Yet further, the projecting portion of the auxiliary blade smoothly extends from the body of the auxiliary blade S into the wake region of the blade B1, and a load on the auxiliary blade (a force of air acting on the unit area of the auxiliary blade) is not substantially changed, with the result that the quantity of discharged air may be increased without increasing the noise level, i.e., the efficiency of the fan may be improved. Moreover, the radially inward and outward surfaces of the auxiliary blade are radially inwardly offset with respect to a line joining the leading edge of the auxiliary blade and the trailing edge. Also, the Figures illustrate the fact that the leading edge of the auxiliary blades begin at a position corresponding to or trailing the leading edge of the primary blades.

The projecting extent or length w of the auxiliary blade corresponds to only 0.1 W (13 mm), so that no strength problem is incurred thereto, as far as the material of the blades is polypropylene, iron, or aluminum base allows which can be practically used with the required strength.

The second embodiment of the axial flow fan of the invention is applied to a blower which cools a heat generating body O in a plant by introducing air from the outside of the plant. In this case, reference is made to FIGS. 6 to 9.

An axial flow fan F2, according to the second embodiment, is equipped with two or more fan blades B2, which extend in the radial direction from a rotary shaft RS which is adapted to be rotated.

Two auxiliary blades S1, S2 are formed on a suction surface I2 of the fan blade B2. The blades S1 and S2 are arranged in parallel relation with each other (this will be referred to as an equal spacing arrangement hereinafter), and the leading ends 19A, 19A' of auxiliary blades S1, S2 are positioned closer to the center of rotation of the fan than trailing ends 19B, 19B' thereof, with smooth curved surfaces or a proper wing-shape being formed between the leading ends and the trailing ends of the blades S1, S2. In addition, the auxiliary blades extend aslant and outward beyond the trailing edge 18B of the fan blade B2 a distance corresponding to less than 0.2 times the chord length W of the blade.

In this case, the trailing end portion of the auxiliary blade S1 provided on the blade B2 in a radially outer position thereof should be positioned at the trailing end of the fan blade B2 and in the radially outermost position thereof.

In addition, the trailing ends 19D of the auxiliary blades S1, S2 have an edge-surface shaped in parallel with the rotational direction 10 of the fan, and one of the side-edges of the extended portions of the auxiliary blades S1, S2 should align with a camber extension line of the blade B2.

The auxiliary blades S1, S2 in this embodiment should desirably be arranged so as to follow a stream line 11 of air streams flowing along the suction surface I2 of a blade. Accordingly, an attaching angle of the auxiliary blade to a blade surface should range from about 5° to 45° (in general, 15 to 30°) with respect to the rotational direction of the fan blade.

The axial flow fan F2 of the aforesaid arrangement is positioned in opposed relation to shielding members M adapted to shut off the air from the exterior of a plant by closing an opening D0 provided in a wall K in the plant. Positioned in the rear of the axial flow fan F2 is a heat generating body O of a large size, which is to be cooled by the air being blown from the fan.

Assume that there is some pressure resistance which hinders the air flow from the fan on the intake side or the discharge side thereof. In the second embodiment, the shielding member M and heat generating body O serve as pressure resistances. When the fan F2 is rotated in the direction of arrow 10, then air streams are created along the pressure surface D2 of the fan blade B2, as in the case of the prior art axial flow fan, while an air blowing action occurs towards the discharge side of the fan, i.e., in the axial direction of the fan.

Meanwhile, the suction surface I2 of the prior art axial flow fan scarcely provides any air blowing action. However, the provision of the auxiliary blade S1, S2 creates both air streams flowing along the surface of the auxiliary blade and centrifugal streams 20. Accordingly, the axial flow fan according to the present embodiment may blow a great quantity of air through the shielding member M to the heat generating body O owing to the centrifugal air streams created by the extended auxiliary blades S1, S2, so that the heat generating body O may be cooled effectively.

A difference in peripheral speed between the leading end 19A and trailing end 19B of the auxiliary blades S1, S2 greatly contributes to the creation of centrifugal air streams 20. According to this embodiment, the auxiliary blade S1 is positioned in the outermost position of fan blade B2, i.e., in the radially outermost position of the fan, and the auxiliary blade S1 extends beyond the trailing edge of the fan blade and hence has a considerable length, with the result that the peripheral speed of the air stream peaks at the trailing end 19B, while no separation of the air stream from the surface of the auxiliary blade S1 takes place, because of the smooth curved surfaces of the auxiliary blade S1, and, in addition, the strong centrifugal air streams 20 are created. It is possible that, for increasing the difference in the peripheral speed, the leading end 19A of the auxiliary blade may be positioned extremely close to the center of rotation of the fan. However, this attempt suffers in that an attaching angle of the auxiliary blade should be extremely increased and hence conflicts the flow pattern of the air streams created by the pressure resistance on the discharge and intake sides of the fan, with the result that the auxiliary blade hinders the smooth flow of air, and thus is affected by the accompanying swirl, separation of air flow, reduction in the quantity of discharged air and an increase in the noise level.

The auxiliary blade S2 is positioned closer to a center of rotation of the fan than the auxiliary blade S1 in parallel therewith, so that an absolute value of the peripheral speed of the blade S2 is not as high as that of the blade S1. However, a difference in peripheral speed between the leading end and the trailing end thereof remains almost the same as that in the case of the blade S1, creating centrifugal air streams 20. Particularly, the centrifugal air streams 20 created by the blade S2 flow aslant along the surface I2 of the blade or into the wake region thereof and along the undersurface of the blade S1 (on the side of the center of rotation of the blade S1), then at the trailing end of the blade S1, joining with the air streams along the upper surface of the blade S1, thereby creating strong centrifugal streams radially outwards.

The strong centrifugal air streams 20 directed aslant and outwards produce air streams in the direction to avert a pressure resistance, in case there is a pressure resistance on the discharge side of the fan. On the other hand, the centrifugal air streams 20 prevent air from the fan from returning to the intake side thereof, i.e., they prevent the recirculation of air CL. As a result, the fan according to the present invention may efficiently cool the heat generating body O by introducing a great quantity of cool air from the exterior of the plant, thus providing advantages in air blowing and cooling effects.

In addition, the end surface of the auxiliary blade is in parallel with the rotational plane of the blade, and hence the area of the extended portion of the auxiliary blade (length of the extended portion is w.) may be increased without increasing the load acting on a fan blade, so that the quantity of discharged air may be increased.

Figure 9:
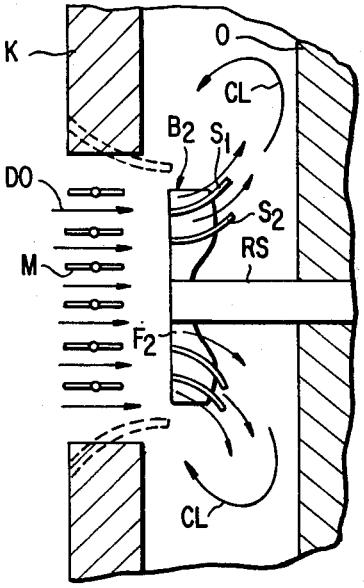

Meanwhile, a shroud, shown by a broken line in FIG. 9, may be attached to the fan according to this embodiment to increase the quantity of the aforesaid centrifugal air streams, while a reverse flow of air passing between the shroud and the fan may be prevented by centrifugal air streams, with the resulting prevention of recirculation of the air, thus allowing the suction and discharge of exterior air of a plant. Thus, there may be provided a fan and its system providing a high efficiency and low noise level.

In addition, in case there is a pressure resistance, such as the heat generating body O in this embodiment, on the discharge side of the fan, which resistance hinders the smooth air flow and changes the flow pattern of air, the air streams flowing along the surface of the fan blade are provided in the form of three dimensional air streams, including the centrifugal air streams, thus providing a complex flow of air.

In the above case, the prior art axial flow fan fails to avoid the formation of swirl on the surface of a blade, noise occuring from the separation of air streams, and impact and interference noise produced when air impinges on the heat generating body O. In contrast thereto, the axial flow fan according to the present invention may create smooth air streams because of the auxiliary blade being arranged along the air streams, while preventing swirl or separation of air streams, as well as resultant noise. In addition, the fan may increase the quantity of discharge air and lower the noise level, comparing with the fan of the prior art having the same number of revolutions.

The axial flow fan according to this embodiment produces an increased quantity of mixed air streams consisting of axial flow as produced by the prior art fan and centrifugal air streams created by the auxiliary blade, thereby providing improved cooling capability. The quantity of discharged air and efficiency of the prior art fan is lowered in case a shielding member M or a heat generating body O is provided. However, by creating stronger centrifugal air streams by projecting auxiliary blades, the fan according to this embodiment may provide a large quantity of cooling air along a large size heat generating body, without being subjected to an influence of a pressure resistance. In addition, the fan according to this embodiment may lower the noise level, and is advantageous from the viewpoint of noise nuisance of such plants.

An axial flow fan according to a third embodiment of the invention is applied to a cooling fan for use in an automobile. Description thereof will now be given of such a fan with reference being made to FIGS. 10A to 12. Like parts are designated by like reference numerals for common use with those given in the second embodiment.

Figure 10A:
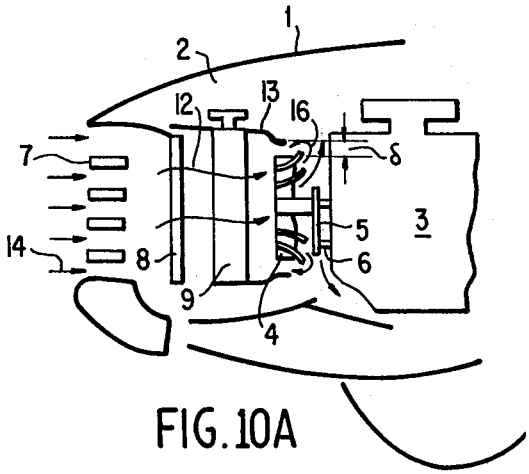
FIGS. 10A to 12 are views showing axial flow fans according to a third embodiment of the present invention.
Figure 10B:
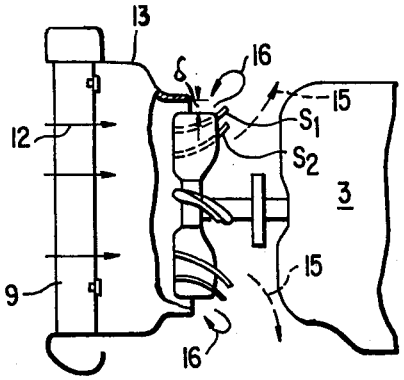
Figure 11:
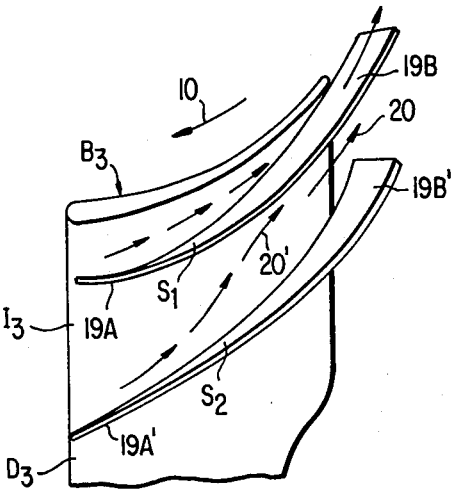
Figure 12:
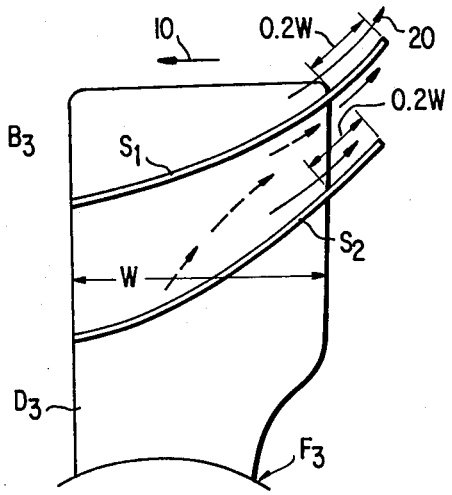

Before going into detail in the description of the axial flow fan according to the third embodiment, a cooling system in an automobile will be described simply by referring to FIGS. 10A and 10B. The cooling system in an automobile includes, from the front of the automobile, a grill 7, a condenser 8, a radiator 9, a shroud 13, a fan 4, an engine block 3 and accessories. Air 12 for use in cooling the radiator 9 consists of air 15 from the fan and ram air 14 created due to the running of the vehicle. A problem encountered with such a cooling system is the difficulty in cooling when the vehicle is stopped or in an idling state. In this case, the cooling air 12 consists of the fan air 15 alone, so that the quantity of fan air 15 plays an important role. Meanwhile, another problem is that the various components are positioned so densely in the cooling system. For the viewpoint of space, the fan should be small in size and able to withstand a high r.p.m., and hence to provide high strength, because the fan is driven by an engine.

On the other hand, in the case of a vehicle running on an upward slope or at a high speed, the cooling system is cooled by mixed air streams of fan air 15 and ram air 14. Accordingly, reduction in the resistance of the air being ventilated and an increase in the quantity of air created by the fan 4 are essential. Furthermore, there has arisen a strong demand for saving in fuel consumption and reduction in noise level for the cooling system, particularly for the fan. There has arisen, especially, a demand to have a highly efficient fan of a low noise level and low power, which retains the desired cooling capability.

Difficulties are encountered with the prior art fans for use under the above conditions. In addition, another difficulty is added thereto from the viewpoint of mass production of the fans. Accordingly, a demand arises for a fan and its system which allows easy manufacture and provides an increased quantity of discharge air with high efficiency.

To this end, the fan and its system should be able to create air streams most suited for the respective application.

In another attempt to enhance the cooling efficiency, a shroud 13 is provided around the fan, so as to introduce a majority of the cooling air 15 through a radiator core. The fan and shroud for use in such a case are spaced apart, with a predetermined clearance $\delta$ (about 20 mm) with the viewpoint of preventing unwanted contact due to vibrations of the engine and ease of assembly, so that there is created a reverse flow 16 from the discharge side through the aforesaid clearance towards the intake side of the fan, and thus only part of the fan air may pass through the radiator, providing low efficiency.

Many attempts have been proposed to prevent the aforesaid reverse flow. However, these are complicated in construction and of poor efficiency. In addition, the provision of a clearance $\delta$ as shown in FIG. 10B is advantageous for the ram air 14 because of the reduction in aerodynamic resistance. Thus, these attempts can hardly find an application in the automobile, and a clearance $\delta$ of over 20 mm is generally provided for automobiles.

The desired cooling effect, resorting to axial flow alone, cannot be achieved, and thus air should be directed radially outwards of the fan in the direction where pressure resistance is small, for many reasons, such as (i) cooling bodies having a large pressure resistance, such as a condenser and a radiator, are positioned on the intake side of a fan, while an engine block hindering the ventilation of air is positioned on the discharge side of the fan, and, as a result, a large difference in pressure prevails between the intake and discharge sides of the fan, and (ii) the direction of air streams is changed by means of an engine block on the discharge side of the fan. In addition, the air streams 11 flowing along the surface of a blade are subjected to the influence of the aforesaid pressure difference and flow aslant in the form of three-dimensional air streams consisting of axial air streams and centrifugal air streams.

In conclusion, such a fan is recommendable for use in a place subjected to the influence of the aforesaid pressure resistance, which provides mixed air streams (aslant air streams) consisting of axial air streams and centrifugal air streams. It is not recommendable, however, to have a device to produce slanting air streams in a cooling system, other than the fan, because of the increased manufacturing cost and the limited space available.

The axial flow fan, according to the present invention, has the advantage in the view of mass production, because aslant centrifugal air streams are positively created only by installing the auxiliary blade on the axial flow fan. Besides, the present invention prevents separation of air streams from the surface of a blade and swirl resulting from the three dimensional flow pattern.

Six fan blades B3 are provided on a rotary shaft of an axial flow fan F3, according to the third embodiment, and extend radially outwards, which shaft is driven by an engine 3.

Two auxiliary blades S1, S2 are formed on a suction surface 13 of each fan blade B3, in a manner that the spacing between the auxiliary blades S1 and S2 on the leading edge side thereof is larger than that on the trailing edge side thereof (this will be referred to as a non-equal spacing arrangement, hereinafter), the front ends 19A, 19A' of auxiliary blades S1, S2 are positioned closer to the center of rotation of the fan than the trailing ends 19B, 19B' thereof, smooth curved surfaces are provided from the leading ends to the trailing ends of the auxiliary blades, and the auxiliary blades extend aslant outwards beyond the trailing edge 18B of the fan blade B3 into the wake region a distance corresponding to 0.2 times (14 mm) a chord length W (70 mm) of the fan blade.

In this case, the trailing end of the auxiliary blade S1 positioned on the radially outer portion of blade B3 should be positioned at the trailing edge, but in the radially outermost position, of the fan blade B3.

The trailing ends 19D of auxiliary blades S1, S2 extend parallel with the rotational direction 10 of the fan, while one of the side-edges of the extended portions of the auxiliary blades S1, S2 should be aligned with a camber extension line of the fan blade B3.

The auxiliary blades S1, S2, according to this embodiment, are formed along a stream line 11 of air streams flowing along the suction surface 13 of the blade, as in the case of the second embodiment, and an attaching angle of the auxiliary blade to the surface of the fan blade ranges from about 5° to 45°, with respect to the rotational direction of the fan. In general, the attaching angles range from 15° to 30°. In this embodiment, the attaching angle of S1 is 15° and that of S2 is 30°.

In case there is some pressure resistance which hinders the smooth flow of air streams on the intake side or discharge side of the fan, when the fan F3, according to the third embodiment, is rotated in the direction of arrow 10, the pressure surface D3 of the fan blade creates air streams along the surface of the blade, as in the prior art axial flow fan, blowing air in the axial direction, i.e., towards the discharge side of the fan.

The suction surface I3 of the fan blades in the prior art axial fan scarcely creates air flow, but the fan having auxiliary blades according to the invention, creates centrifugal air streams 20 as well as air streams flowing along the surfaces of the auxiliary blades S1, S2.

A difference in the peripheral speed of the air streams at the leading ends 19A and trailing ends 19B of the auxiliary blades S1, S2 greatly contributes to the formation of the centrifugal air streams 20. According to this embodiment, the auxiliary blade S1 is positioned at the outermost end of the fan blade, i.e., in a radially outermost position of the trailing edge of the fan blade, and extends beyond the trailing edge of the fan blade, with the result that the peripheral speed of the air streams peaks at the trailing end 19B. In addition, the auxiliary blade S1 has smooth curved surfaces for preventing the separation of the air streams from the surface of the auxiliary blade S1 and for providing smooth but strong centrifugal air streams 20. It is possible to bring the leading end 19A of the auxiliary blade too close to the center of rotation of the fan for the purpose of increasing the difference in the peripheral speed of the air streams. However, this attempt results in a fan which provides an extremely large attaching angle for the auxiliary blades in non-conformity with a pattern of air streams created by pressure resistances on both the intake and discharge sides of the fan. As a result, the auxiliary blades hinder the smooth air flow and produce swirl and separation of the air streams from the surface of the blade, thus resulting in reduction in the quantity of the discharge air and an increase in noise level.

The auxiliary blade S2 is positioned closer to the center of rotation of the fan than the auxiliary blade S1, and arranged in non-equal spacing relation, so that an absolute value of the peripheral speed of the auxiliary blade S2 cannot be increased as much as that of the auxiliary blade S1. However, a difference in the peripheral speed of the auxiliary blade S2 is greater than that of the auxiliary blade S1, so that there may be created centrifugal air streams 20' stronger than those in the second embodiment. The centrifugal air streams 20' flow along the surface 13 aslant into the wake region of the fan, and lastly along the undersurface of the blade S1 (on the side of the center of rotation of the fan) and then aslant outwards from the trailing end of the blade S1. Those centrifugal air streams flow out strongly, joining with air streams flowing along the upper surface of the auxiliary blade S1.

With the axial flow fan according to the third embodiment, the centrifugal air streams 20 created by the auxiliary blades S1, S2 slant outwards, then flow in a manner to avert a large size pressure resistance, i.e., such as an engine 3 positioned on the discharge side of the fan, but along the engine 3, thus increasing the quantity of discharge air and its air-blowing efficiency. As in the case of a cooling fan 4 for use in an automobile, according to this embodiment, i.e., in the case of a suction type fan wherein a radiator 9 is positioned in front of the fan, and yet in case there is provided a shroud 13, then there may be prevented a reverse flow of air streams 16 which has been caused by a difference in pressure between the discharge and intake sides of the fan, and which are directed so as to pass through a clearance between the fan and the shroud, while the quantity of discharge air may be increased due to the centrifugal air streams from the fan. In addition, the whole air stream created by the fan may be utilized for cooling the radiator 9, thereby markedly enhancing the cooling efficiency thereof. Tests given to the fan according to the present invention and the prior art fan reveal that the quantity of discharge air may be increased by about 35% and the cooling performance may be improved by about 20%, in the case of a fan formed according to the invention.

In addition, because the end surfaces of the auxiliary blades are positioned parallel with the rotational plane of the fan, the areas of the auxiliary blades may be increased relative to the extended length w of the auxiliary blade, so that the quantity of discharge air may be increased without increasing the load on the blade. As a result, the noise may be reduced to the same level as in the prior art fan or to 0.5 to 1 dB (A).

According to the fan 4 in this embodiment, in case a large quantity of air should be passed through a pressure resistance, such as a radiator (a resistance on the intake side of the fan) within an engine room, wherein various components are positioned in compact relation, strong centrifugal air streams 20 may be created by the auxiliary blades S1, S2, which extend beyond the trailing edge of the fan blade, so that the quantity of discharge air may be increased with an accompanying increase in air blowing efficiency. As a result, a large quantity of air may be passed through the radiator, i.e., a heat exchanger, for cooling water for an engine, thereby solving an overheating problem of an engine, and enabling a reduction in the size of the radiator. Recently, an exhaust gas treating device was positioned within an engine room for emission control, and the engine room became further dense with various components and, as a result, heat tended to stagnate therein in a high temperature condition. However, the fan according to the third embodiment provides strong centrifugal air streams by means of the projecting auxiliary blades, thereby improving the air flow in the engine room and eliminating such the stagnation of heat flow and high temperature problems. Recently, a noise problem has been posed in the automobile industry. The fan is one of the major sources of noise in an automobile. However, according to the fan in the third embodiment, even if the quantity of discharge air is increased and the air blowing efficiency is improved by the auxiliary blades which extend beyond the trailing edge of the fan blade, the noise level is not increased.

Figure 13:
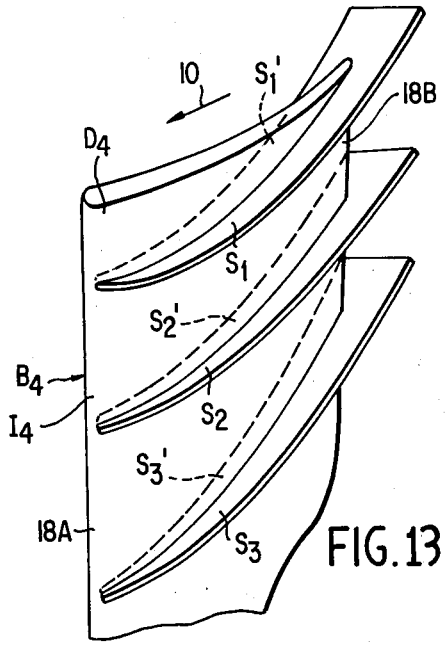
FIGS. 13 to 15 are views showing axial flow fans according to a fourth embodiment of the present invention.
Figure 14:
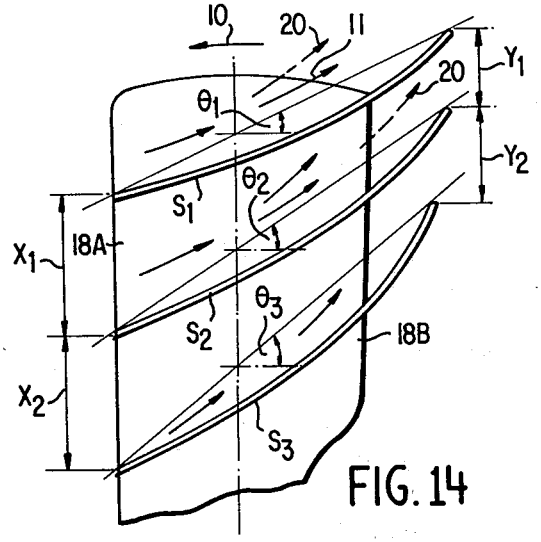
Figure 15:
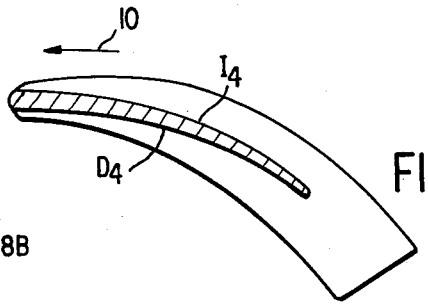

The axial flow fan according to the fourth embodiment is applied to a cooling fan in an automobile, as in the case of the third embodiment, and will be described now with reference to FIGS. 13 to 15.

The axial flow fan F4, according to the fourth embodiment, includes four fan blades B4 which extend from a rotary shaft radially thereof, which shaft is driven by the engine.

The auxiliary blades S1, S2', S3 . . . S1', S2', are formed on a suction surface I4 and a pressure surface D4 of the fan blade B4, respectively. Spacings X1, X2 between the two auxiliary blades at the leading edge 18A of the fan blade B4 are the largest and then decreased towards the trailing edge thereof (non-equal spacing arrangement), while the auxiliary blades provide smooth curved surfaces between the leading ends and trailing ends thereof. The auxiliary blades S1 and S1', S2 and S2', and S3 and S3' from the same plane in cooperation, and extend beyond the trailing edge 18B of the fan blade B4 aslant radially outwards a distance corresponding to 0.3 times the chord length W of the blade.

The auxiliary blades S1 and S2, (or S1' and S2') and S2 and S3 (or S2' and S3') are of such shapes as not to intersect with each other on extension lines thereof.

Fans of this type find application as fans having a large diameter (over 400 mm) and adapted for use as a fan for which are required a large quantity of air and high pressure.

In case the fan according to this embodiment is used with a pressure resistance, such as an obstruction, cooling body or the like being positioned on the intake side or discharge side of the fan, when the fan is rotated in the direction of arrow 10, air streams 11 flowing from the leading end 18A to the trailing end 18B of the surface of the fan blade are subjected to influence by a pressure resistance on the pressure surface D4 of the fan blade, so that air streams 11 are deflected in the radial direction, in which the pressure impedance is small, and thus three-dimensional streams are created on the surface of the blade.

The three dimensional air streams are created more markedly approaching the trailing edge of the fan blade, or approaching the center of rotation of the fan. Accordingly, in the case of auxiliary blades S1, S2, S3, being provided along the stream lines, there are created smooth air streams along the surface of the auxiliary blade without hindering of the smooth flow of air streams 11 along the surface of the fan blade. The attaching angles of the auxiliary blades, S1, S2, S3 range from 5° to 45° with respect to the direction of rotation, and the attaching angle of S1 is greater than that of S2 and the attaching angle of S2 is greater than that of S3, so that the air streams 20 in the centrifugal direction are enhanced by the auxiliary blades, while the centrifugal component of the air streams becomes stronger and greater due to the differences in the angles and the peripheral speeds, towards the trailing edge 18B of the fan blade. The same phenomenon takes place on the suction surface I4 of the fan blade. The suction surface of the prior art fan blade does not contribute to an air blowing action. However, there are created threedimensional air streams on the surface of a fan blade under the influence of a pressure resistance.

Due to the provision of the auxiliary blades extending along a stream line, there are created air streams flowing along the surfaces of the auxiliary blades and centrifugal air streams created due to differences in the attaching angle of and the peripheral speed of the auxiliary blades, so that strong air streams are directed aslant outwards from the trailing edge of the fan blade B4.

For making the centrifugal air streams stronger, the attaching angles and the difference in peripheral speed may be increased. However, an increase in the attaching angle often leads to a deviation of the auxiliary blades from the stream line on the surface of the fan blade, and conversely, the auxiliary blades hinder the smooth line of air, thus causing swirl and separation of air streams from the surface of the blade, so that the performance of the fan is impaired and the level of noise is abnormally increased. For attaining the aforesaid requirements without hindering the smooth line of the air stream, the auxiliary blades should smoothly extend into the wake region of the fan blades to increase especially the difference of peripheral speed, so that strong air streams are created. In addition, the strong centrifugal air streams at the trailing edge of the fan blade may be effectively utilized, so that there may be achieved a fan having an improved air blowing characteristic and an increased quantity of discharge air.

In addition, the auxiliary blade closer to the center of rotation of the fan has a larger attaching angle both on the pressure surface D4 and on the suction surface I4 of the fan blade, that is, the auxiliary blades are positioned in non-equal spacing relation. As a result, air streams flowing on the surface of the auxiliary blade on the side of the center of rotation of a fan are utilized so as to deflect air streams in the centrifugal direction, and centrifugal air streams created by the auxiliary blade S2 are directed towards the undersurface of the blade S1, and the centrifugal air streams created by the blade S3 are directed towards the undersurface of the blade S2, so that the air streams flowing along the undersurfaces of the auxiliary blades are joined with air streams flowing along the upper surfaces of the auxiliary blades. Thus, strong air streams are created towards the discharge side from the trailing ends of the auxiliary blades, so that the range of air to be blown on the discharge side may be increased, and a reverse flow of air from the discharge side towards the intake side of a fan may be prevented. In addition, extending or protruding portions of the auxiliary blades both on the suction and pressure surfaces of the fan blade are joined together to provide the same plane, so that a large blade area may be achieved, without increasing the blade load. As a result, the quantity of discharge air may be increased, without affecting noise and power.

The reason why the length of the extended or protruding portion of the auxiliary blade is selected to be 0.3 W is that this portion is positioned within a wake region of the fan blade B4, and thus inflowing air is not separated from the surfaces of the auxiliary blades in the centrifugal direction, providing the highest air-blowing efficiency and a minimized noise level, as proved by the tests.

According to the axial flow fan in the fourth embodiment, as in the third embodiment, strong centrifugal air streams are created by means of protruding portions of auxiliary blades S1 to S3, and S1' to S3', both on the suction side I4 and the pressure side D4 of the fan blade, so that air smoothly flows along the engine. As a result, the quantity of discharge air, as well as the air blowing efficiency, may be increased. It follows then that the quantity of air (intake air) passing though a radiator is increased, thereby eliminating overheating in an engine, and enabling reduction in size of the radiator. Furthermore, the air flow within an engine room is rendered smooth, the temperature therein may be lowered, and a heat-dwelling phenomenon is avoided. In addition, the noise level attained is substantially the same as that of a prior art fan having auxiliary blades.

Description will now be turned to the axial flow fan according to the fifth embodiment of the invention, which is applied to a cooling fan for use in an automobile.

Accompanying the fact that the auxiliary blades of the axial flow fan F5 in the fifth embodiment are extended from the trailing edge of the fan blade, the fan blade is also protruded in an arcuate shape to reinforce the extended portion of the auxiliary blade. This will be described in more detail with reference to FIGS. 16 to 18.

Two or more auxiliary blades S1, S2 are provided in non-equal spacing relation at the suction surface I5 on two or more fan blades B5 secured to a rotary shaft of an axial flow fan F5 in the radial direction, which shaft is driven by an engine. The auxiliary blade S1, is positioned in the radially outermost portion of the fan blade B5. The auxiliary blades S1, S2 . . . extend beyond the railing edge of the fan blade B5 a given distance of 0.3 W, wherein W represents a chord length of a fan blade.

Figure 16:
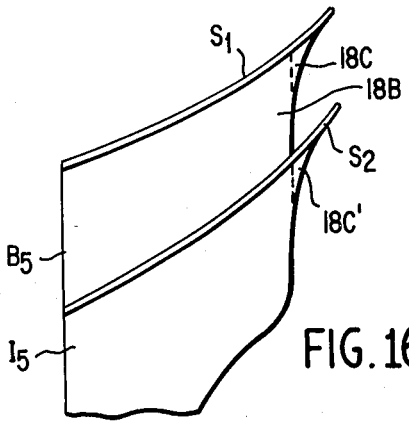
FIGS. 16 to 18 are views showing axial flow fans according to a fifth embodiment of the invention.
Figure 17:
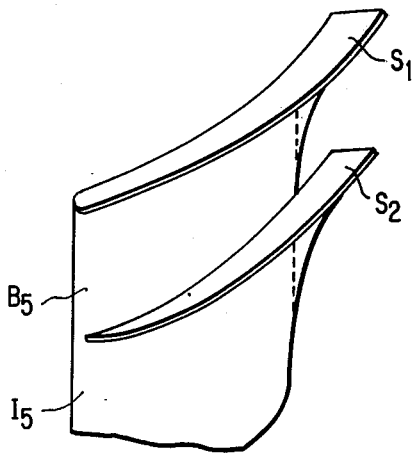

An extended portion of the auxiliary blade is generally made of polypropylene, iron, aluminum or the like, which is yieldable due to an external force. For this reason, in case the diameter of a fan is large or the auxiliary blade is positioned close to the tip of a fan blade, the centrifugal force created by rotation of the fan acts on the auxiliary blade, when the extended portion is greater than 0.3 W to such an extent that the auxiliary blade tends to be deformed or bent outwards, causing vibrations, deformations and breakage. A force of air, which tends to bend the auxiliary blade towards the center of rotation of the fan, acts on the extended portion of the auxiliary blade. However, the centrifugal force is generally greater than the aforesaid force of air, and acts on the auxiliary blade so as to bend the same outwards. To prevent the extended portion of the auxiliary blade from bending, the trailing edge portion 18B of the fan blade B4 is enlarged so as to provide reinforcing portions or fillets 18C, 18C' of an arcuate shape, as shown in FIGS. 16 and 17. This not only prevents the deformation of an extended portion of the auxiliary blade, but also increases the area of the trailing edge portion of the fan blade B5, with a resulting slight increase in the quantity of discharge air.

Figure 18:
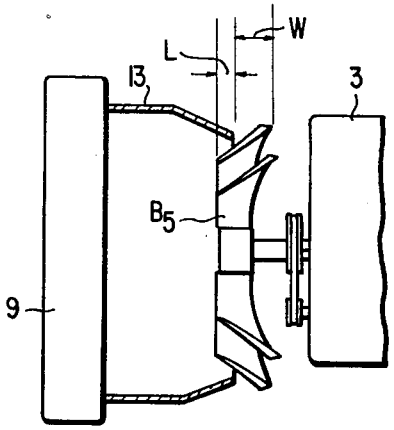

In addition, according to this embodiment, the auxiliary blade S1 extending outwards is positioned on the fan blade B5 in the radially outermost portion thereof, so that a portion of the fan blade which provides the highest peripheral speed may be utilized for the auxiliary blade, thus allowing the formation of strong centrifugal air streams. This increases the quantity of discharge air and air-blowing efficiency of a fan. As shown in FIG. 18, half the axial width W of the fan blade B5 ($L=\frac{1}{2}$ W) is positioned within a shroud 13 extending from the radiator 9 towards the fan, so that a clearance between the blade B5 and the shroud 13 may be reduced, while the centrifugal air streams created by the auxiliary blade draw a reverse flow therewith, thereby preventing the reverse flow of air flowing from the discharge side of the fan through the aforesaid clearance towards the intake side of the fan and increasing the quantity of discharge air at a high air-blowing efficiency. In addition, the shroud 13 may prevent the re-circulation of air. The auxiliary blade S1 may be positioned in theradially outermost portion of the fan blade according to this embodiment by eliminating a portion of the fan blade which extends radially outwards from the auxiliary blade S1 in the preceding embodiments. Thus, the weight of the fan blade may be reduced to some extent and the size and manufacturing cost thereof may be reduced.

The fan according to the fifth embodiment may act in the same manner as that of the fans according to the preceding embodiments.

Figure 19:
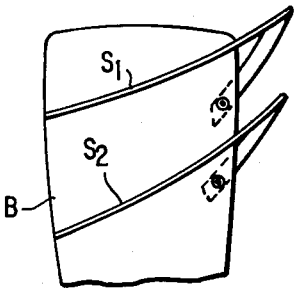
FIGS. 19 to 31 are views showing further modifications of the fans according to the present invention.

One modification of the axial flow fan of the fifth embodiment will be given below. As shown in FIG. 19, the trailing end of the auxiliary blade is coupled to the trailing end of the fan blade by means of connecting members such as rectangular plates or rods, and then the connecting members are secured to the fan blade and auxiliary blade by means of rivets or screws, or by welding or brazing.

Figure 20:
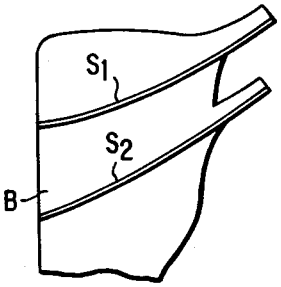
Figure 21:
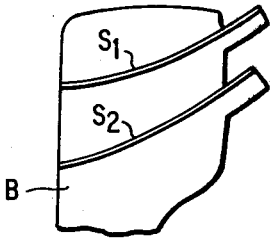

FIGS. 20 and 21 show other modifications wherein lugs extend from the trailing end of the fan blade along with an extended portion of the auxiliary blade, in integral relation thereto, thereby providing an extended portion of an L-shaped cross section, thus coping with a bending moment. According to the embodiments of FIGS. 20 and 21, the blades may be made of plastic so as to provide an integral construction of fan blade and auxiliary blade, presenting advantages in manufacture.

Figure 22B:
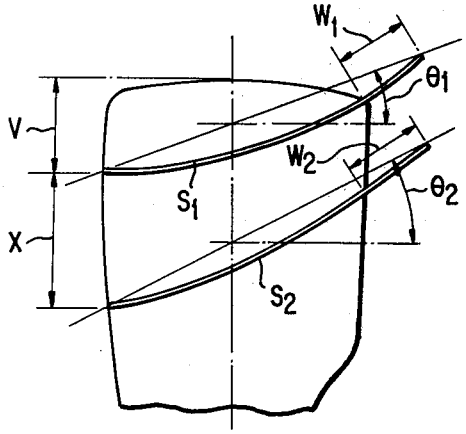
Figure 22C:
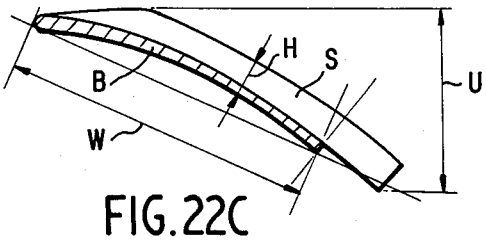
Figure 23A:
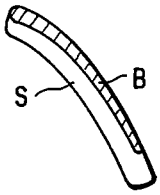
Figure 23B:
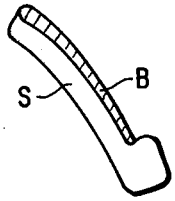
Figure 23C:
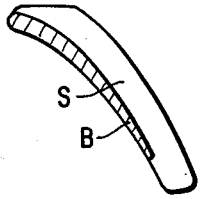
Figure 23D:
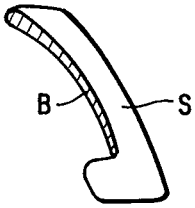
Figure 22A:
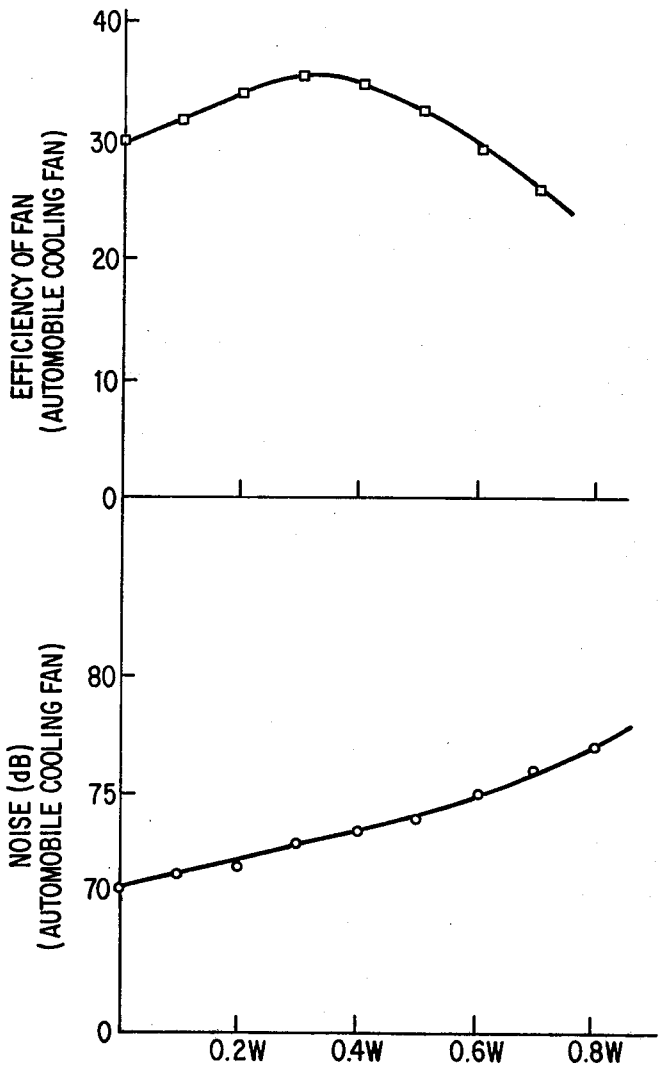
Figure 22:
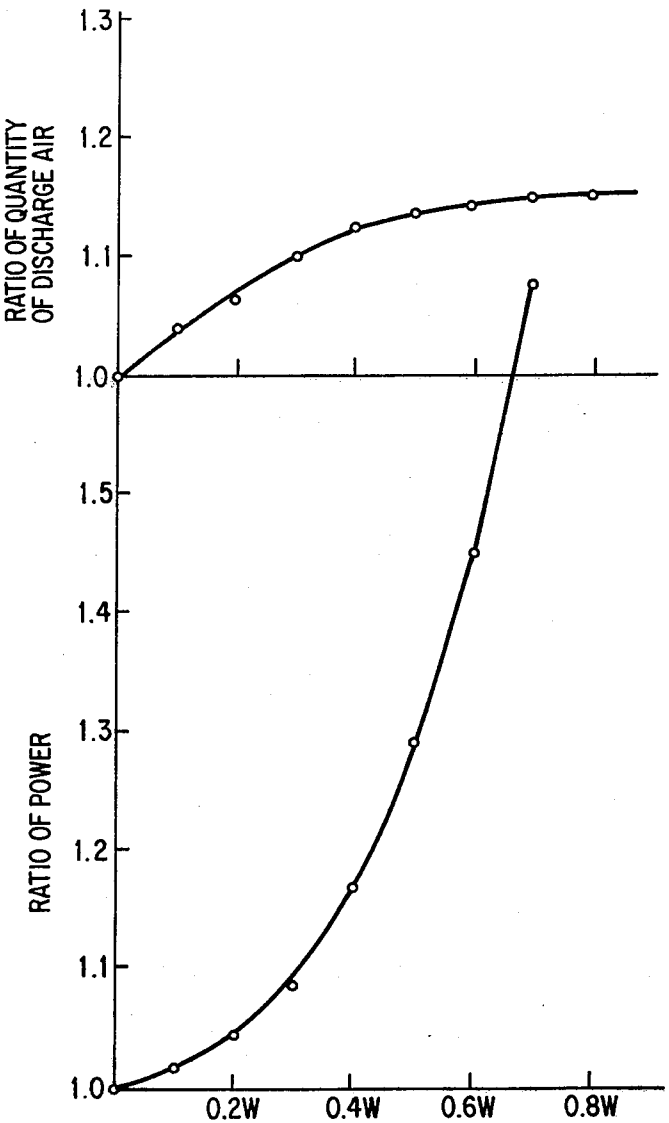

Tests were given to the third embodiment, wherein an extended length of the auxiliary blade was varied for investigating the characteristics of the auxiliary blade. The results of the tests are described hereunder, with reference to FIGS. 22 to 22(C).

The dimensions of the fan used in these tests are as follows:

1. Fan having auxiliary blades formed on the suction surface of fan blade... 6 blades × 380 mm in diameter -continued

| | |
|---|---|
| 2. | Chord length of fan blade ... W = 70 mm (max.) |
| 3. | Auxiliary blade ... two/fan blade |
| 4. | Attaching angle of auxiliary blades S1 ... 01 = 21° to 28° (in case of 0.8 W .. extended portion) |
| | Attaching angle of auxiliary blade S2 ... 02 = 30° to 35° (in case of 0.8 W .. extended portion) |
| 5. | Spacing between leading edges of auxiliary blades: |
| | V = 25 mm |
| | X = 40 mm |
| 6. | Height (width) of auxiliary blade H = 10 mm |
| 7. | Length of an extended portion of auxiliary blade, w1 = w2 = 0 to 0.8 W. |

This varies in increments of 0.1 W.

In these tests, there was used an axial flow fan having auxiliary blades having perpendicular trailing edge surfaces against a camber line of a fan blade, with the side-edge of an auxiliary blade being positioned on an extension line of a camber line and its edge surface being also perpendicular to the extension line of a camber line.

An air-blowing efficiency peaks at w=0.3 W and in case w is greater than 0.3, the efficiency is lowered. Especially in case w is greater than 0.5 W, the efficiency falls lower than that of a standard type fan. In case w>0.5 W, then the axial width U of the fan is increased from 40 to 70 mm, thus increasing an attaching space of the fan. As an extended portion of the auxiliary blade becomes longer, the limitations arising from the deformation due to a centrifugal force and strength are incurred. Accordingly, amn extended portion of the auxiliary blade should range as follows:

$$0.5\ W \geqq w > 0$$

The most suitable value is w=0.3 W.

EXAMPLE OF MODIFICATION

Meanwhile, according to the fourth embodiment, three auxiliary blades are provided on the suction and pressure surfaces of a fan blade and extend into a wake region of the fan blade. However, three auxiliary blades of the same length as above may be formed on the pressure surface along of the blade of a fan, as in the first embodiment. In this case, centrifugal air streams are added, although the strength of the air streams is not so great as in the fourth embodiment, and thus the fan thus modified may provide a quantity of discharge air greater than that of a prior art fan.

In case three or more auxiliary blades are provided on the suction surface of a fan blade alone, as in the second embodiment, then there results a mixed flow of centrifugal air streams and axial air streams which is blown aslant outwards of the fan, thus providing discharge air of nearly the same quantity as that in the fourth embodiment. On the other hand, since the auxiliary blade is not formed on a pressure surface of a fan blade, the noise level and power are improved slightly in case the same quantity of discharge air is taken.

In this case, the shape of an extended portion of the auxiliary blade may be the same as those given in the first to third embodiments. However, for increasing the area of an auxiliary blade, the surfaces of the auxiliary blade may be increased as shown in FIGS. 23(A) to 23(D). This permits an increase in the quantity of discharge air, without increasing the load on a blade, thus presenting a desirable air-quantity-versus-noise characteristic.

In addition, a principle, in which an attaching angle of one auxiliary blade with respect to the direction of rotation of the fan, which is positioned closer to the center of rotation, is increased, as compared with that of another auxiliary blade positioned further from the center of rotation, so as to very spacings between the auxiliary blades, as in the third and fourth embodiments, may also be applied to the second embodiment. Namely, by increasing an attaching angle of one of two auxiliary blades, which is positioned closer to the center of rotation of the fan as compared with that of the other, it is possible to make such auxiliary blade positioned along stronger centrifugal air streams which are able to be created at the trailing edge of the fan blade and near the center of rotation of the fan. As a result, the quantity of discharge air may be increased, without increasing the noise level, at a high air-blowing efficiency, i.e., by increasing an attaching angle of the auxiliary blade S2.

Figure 24:
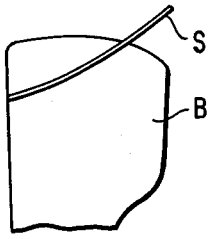
Figure 25:
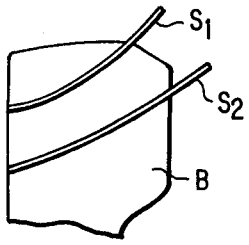

The shapes of an extended portion of the auxiliary blade should not necessarily be limited to those given in the preceding embodiments. In other words, although there is a limitation arising from an outer diameter of a fan, the auxiliary blade may be extended in a radial direction, as shown in FIGS. 24, and 25. This type fan is best applicable to a fan, in which a cut-away portion is provided in the trailing edge of a fan blade and yet in the radially outermost portion thereof. This increases the peripheral speed of air, and is particularly suited when strong centrifugal air streams alone are required.

The fan, as shown in FIG. 25, which includes two or more auxiliary blades may provide the same advantages or effects. However, this is particularly useful when there is an allowance made in the diameter of a fan.

Figure 26:
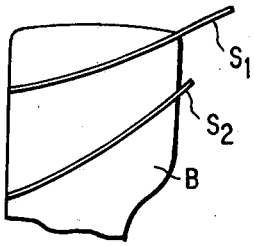
Figure 27:
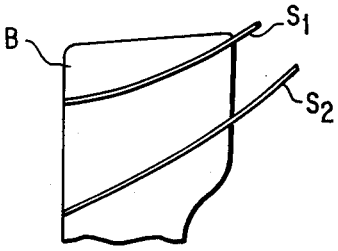

Furthermore, the lengths of two or more auxiliary blades should not necessarily be the same. For instance, as shown in FIG. 26, the auxiliary blade positioned in the radially outermost position of a fan is longer than that positioned closer to the center of rotation of a fan. This type fan provides an increased peripheral speed of air, and hence provides strong centrifugal air streams on the discharge side of the fan. In case the auxiliary blade positioned closer to the center of rotation of a fan is extended longer than that of the other, as shown in FIG. 27, there may be obtained strong centrifugal air steams by the second auxiliary blade, although the centrifugal air streams are not so strong as those obtained in the preceding embodiments. However, this is excellent from the viewpoint of deformation of the blade.

Figure 28:
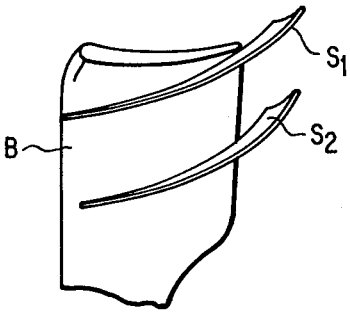

As shown in FIG. 28, the auxiliary blade is inclined radially outwards, with an inclination being increased towards the trailing end of a fan blade. In this type fan, a strong external force is created by the inclined blade, so that there results much stronger centrifugal air streams. In this case, the separation of air streams does not occur, while the air flows from the leading end to the trailing end of the auxiliary blade, thus increasing the quantity of discharge air.

Figure 29:
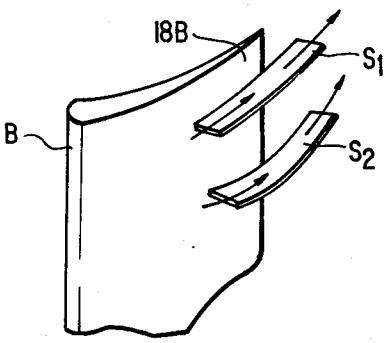
Figure 30:
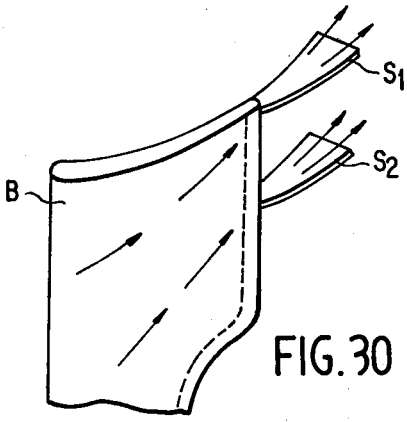

Meanwhile, the auxiliary blade S should not necessarily cover the whole chord length of the fan blade B. For instance, as shown in FIG. 29, even in case an auxiliary blade formed merely on the trailing edge portion 18B of the fan blade extends beyond the trailing edge thereof, or even in case of the auxiliary blade the whole of which extends beyond the trailing edge of the fan blade, as shown in FIG. 30, the same advantages as those of the preceding embodiments may result, and thus various modifications may be adopted, as the case may be.

Figure 31:
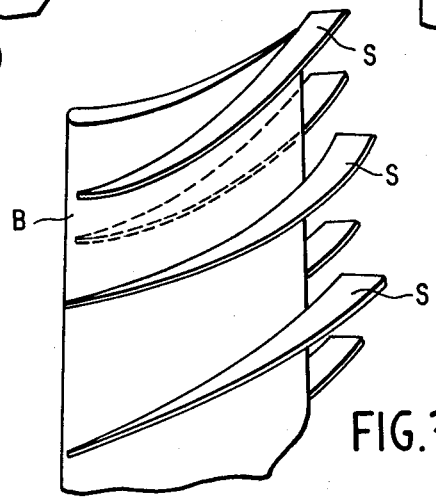

The axial flow fan having the auxiliary blades creating centrifugal air streams should not necessarily be limited to the fourth embodiment, and the positions of auxiliary blades formed on the suction surface $I_4$ and pressure surface $D_4$, as shown in FIG. 31, need not always be the same. Even at an extended portion of the auxiliary blade, the auxiliary blades need not necessarily be at the same positions on the intake and discharge sides thereof, and they may be provided on different levels of alternately. Thus, the position of the auxiliary blades of the fan F4 may be freely selected to suit the circumferential pressure resistance and the required shape. Accordingly, the fans in these embodiments may well accommodate themselves to the cases where there is a considerable difference in pressure resistance between the discharge and intake sides of a fan, or where the modes of air streams flowing on the surface of a fan blade vary markedly between the intake and discharge sides of a fan, insuring desired efficiency.

The reason why one auxiliary blade is provided on the radially outermost portion of a fan blade B5 (Fifth embodiment) is that the tip portion of the blade adds to the effective area for creating centrifugal air streams, and this structure can prevent swirl at the tip of the blade due to a difference in pressure thereat as well as a frictional loss of centrifugal air streams on the surface of the blade B5, thereby eliminating ineffective area and hence improving the performance of the fan. Otherwise, the tip of the fan blade may be removed for reducing the volume of the fan, as well as its weight and size.

The same results may be achieved in the cases where the auxiliary blades S1, S2 are formed on the pressure surface of the blade or where the auxiliary blades S1, S2 are provided on both the suction surface and pressure surface of the fan blade, other than as in the case of the fifth embodiment.

In short, according to the present invention, an auxiliary blade or blades are formed on a fan blade in a manner to extend the trailing edge of the fan blade, thereby creating centrifugal air streams stronger than those obtained by the prior art fan, over a large range and at a large quantity, this improving the air-blowing efficiency of the fan. The fan, according to the present invention, is particularly useful in applications where a resistance body is present on the discharge side of a fan, because of an extended portion of the auxiliary blade, which facilitates the creation of strong centrifugal air streams along the surface of the auxiliary blade, with a resulting increase or improvement in the quantity of discharge air and air-blowing efficiency. Thus, the axial flow fan according to the present invention is best adapted for use in cases wherein there are many pressure resistances on the intake and discharge sides of a cooling fan in an automobile.

While the present invention has been described herein with reference to certain exemplary embodiments thereof, it should be understood that various changes, modifications and alterations may be effected without departing from the spirit and the scope of the present invention, as defined in the appended claims.

What is claimed as new and desired to be secured by Letters Patent of the United States is:

1. An axial flow fan having at least one auxiliary blade comprising:

a hub member rotatably supported and driven by a drive source;

a plurality of primary blades having a predetermined angle with respect to the rotational direction thereof and a predetermined width and height, said primary blades being radially provided on said hub member and each including a leading edge; and at least one auxiliary blade disposed on at least one of a suction and pressure surface of said primary blades, and extending beyond an end portion of a trailing edge of said primary blade, said auxiliary blade extending substantially within a predetermined length in a width direction of said primary blade on said surface thereof, a leading edge of said auxiliary blade being positioned closer to an axis of the fan than a trailing edge of said auxiliary blade and beginning at a position corresponding to or trailing the leading edge of said primary blade, whereby a radial flow is increased by said extending portion of said auxiliary blade.

2. An axial flow fan having at least one auxiliary blade according to claim 1, wherein the length w of said extending portion of said auxiliary blade has a relation to the length W of said width of said blade as follows:

$$0 < w \leqq \tfrac{1}{2}W.$$

3. An axial flow fan having at least one auxiliary blade according to claim 1, wherein at least two auxiliary blades are provided on each of said plurality of primary blades.

4. An axial flow fan having at least one auxiliary blade according to claim 1, further comprising:

a reinforcing member, for reinforcing said extended portion of said auxiliary blade, connected to said trailing edge and said extended portion of said auxiliary blade.

5. An axial flow fan having at least one auxiliary blade according to claim 1, wherein, said auxiliary blade is positioned in the radially outermost portion of said primary blade.

6. An axial flow fan having at least one auxiliary blade according to claim 1, wherein, said auxiliary blade is inclined radially outwardly at predetermined angles with respect to the surface of said primary blade.

7. An axial flow fan having at least one auxiliary blade according to claim 3, wherein, said auxiliary blades are respectively provided in parallel relation.

8. An axial flow fan having at least one auxiliary blade according to claim 3, wherein, the distance between said two adjacent auxiliary blades at said leading edges thereof in the radial direction of said primary blade is larger than that at said trailing edges thereof, whereby said radial flow of said auxiliary blades is increased.

9. An axial flow fan having at least one auxiliary blade according to claim 1, wherein, said extended portion of said auxiliary blade is extended from the radially outermost portion of said primary blade.

10. An axial flow fan having at least one auxiliary blade according to claim 1, wherein, said auxiliary blade is provided from a leading edge of said primary blade beyond said end portion of said trailing edge of said blade.

11. An axial flow fan having at least one auxiliary blade according to claim 1, wherein, said auxiliary blade is provided from said trailing edge of said primary blade beyond said end portion of said trailing edge of said primary blade.

12. An axial flow fan having at least one auxiliary blade according to claim 1, wherein said auxiliary blade comprises only said extended portion thereof.

13. An axial flow fan having at least one auxiliary blade according to claim 4, wherein, said reinforcing member comprises one selected from the group consisting of: a projecting portion of an arcuate shape, integrally connected to said auxiliary blade, provided extendingly from an end portion of a trailing edge of said primary blade; a projecting portion of a rectangular shape along said auxiliary blade, integrally connected to said auxiliary blade, provided extendingly from an end portion of a trailing edge of said primary blade; and a rectangular member secured to a trailing edge portion of said primary blade and said auxiliary blade by means of rivets or screws, and welding or brazing.

14. An axial flow fan having at least one auxiliary blade according to claim 3, wherein, said auxiliary blades are provided on one selected from the group consisting of only a suction surface of said blade, only a pressure surface of said blade, both of a suction and a pressure surface of said blade, respectively, and a suction surface of said blade and a pressure surface of said blade, alternately.

15. An axial flow fan having at least one auxiliary blade according to claim 1, wherein, one auxiliary blade is respectively on each pressure surface of four primary blades, and the length of said extended portion of said auxiliary blade is 1/10 of the width of said primary blade.

16. An axial flow fan having at least one auxiliary blade comprising:

a hub member rotatably supported and driven by a drive source;

a plurality of primary blades having a predetermined angle with respect to the rotational direction thereof and a predetermined width and height, said primary blades being radially provided on said hub member; and at least one auxiliary blade disposed on at least one of a suction and pressure surface of said primary blades, and extending beyond an end portion of a trailing edge of said primary blade, said auxiliary blade extending substantially within a predetermined length in a width direction of said primary blade on said surface thereof, a leading edge of said auxiliary blade being positioned closer to an axis of the fan than a trailing edge of said auxiliary blade, whereby a radial flow is increased by said extending portion of said auxiliary blade and wherein, one auxiliary blade is respectively on each pressure surface of four primary blades, and the length of said extended portion of said auxiliary blade is 1/10 of the width of said primary blade and wherein, said axial flow fan is an electric motor fan having a casing surrounding said primary blades;

the length of said extended portion of said auxiliary blade provided along an extended camber line in the rear of said primary blade being 13 mm, the height of said auxiliary blade being 10 mm, and an attaching angle $\theta$, formed by a line connecting an end portion of a leading edge of said auxiliary blade to an end portion of a trailing edge thereof and the direction of rotation of said blade, is selected as 10°.

17. An axial flow fan having at least one auxiliary blade according to claim 7, wherein, two auxiliary blades are respectively on each suction surface of a plurality of primary blades, and the length of said extended portion of said auxiliary blades is 1/5 of the width of said primary blade.

18. An axial flow fan having at least one auxiliary blade comprising:

a hub member rotatably supported and driven by a drive source;

a plurality of primary blades having a predetermined angle with respect to the rotational direction thereof and a predetermined width and height, said primary blades being radially provided on said hub member; and at least one auxiliary blade disposed on at least one of a suction and pressure surface of said primary blades, and extending beyond an end portion of a trailing edge of said primary blade, said auxiliary blade extending substantially within a predetermined length in a width direction of said primary blade on said surface thereof, a leading edge of said auxiliary blade being positioned closer to an axis of the fan than a trailing edge of said auxiliary blade, whereby a radial flow is increased by said extending portion of said auxiliary blade wherein, at least two auxiliary blades are provided on each of said plurality of primary blades, said auxiliary blades are respectively provided in parallel relation, two auxiliary blades are respectively on each suction surface of a plurality of primary blades, the length of said extended portion of said auxiliary blades is 1/5 of the width of said primary blade, said axial flow fan is applied to a blower which cools a heat generating body in a plant by introducing air from outside the plant and is provided opposite to a throttled part of a shroud equipped with a wall in said plant, and said extended portion of said auxiliary blade is provided along an extension camber line in the rear of said primary blade, the height of said auxiliary blade is gradually increased from said leading edge to said trailing edge and an attaching angle $\theta$, formed by a line connecting an end portion of said leading edge of said auxiliary blade to an end portion of a trailing edge thereof and the direction of rotation of said blade ranges from about 5° to 45°.

19. An axial flow fan having at least one auxiliary blade according to claim 8, wherein, two auxiliary blades are respectively on each suction surface of six primary blades, and the length of said extended portion of each of said auxiliary blades is 1/5 of the width of said primary blades.

20. An axial flow fan having at least one auxiliary blade comprising:

a hub member rotatably supported and driven by a drive source;

a plurality of primary blades having a predetermined angle with respect to the rotational direction thereof and a predetermined width and height, said primary blades being radially provided on said hub member; and at least one auxiliary blade disposed on at least one of a suction and pressure surface of said primary blades, and extending beyond an end portion of a trailing edge of said primary blade, said auxiliary blade extending substantially within a predetermined length in a width direction of said primary blade on said surface thereof, a leading edge of said auxiliary blade being positioned closer to an axis of the fan than a trailing edge of said auxiliary blade, whereby a radial flow is increased by said extending portion of said auxiliary blade and wherein, at least two auxiliary blades are provided on each of said plurality of primary blades, the distance between said two adjacent auxiliary blades at said leading edges thereof in the radial direction of said primary blade is larger than that at said trailing edges thereof whereby said radial flow of said auxiliary blades is increased, two auxiliary blades are respectively on each suction surface of six primary blades, the length of said extended portion of each of said auxiliary blades is 1/5 of the width of said primary blades, and said axial flow fan is applied to a radiator fan which is provided between a radiator and an engine driving said radiator fan and which is surrounded by a throttled part of a shroud fixed to said radiator with an enlarged part thereof, the length of said extended portion of said auxiliary blade provided along an extended camber line in the rear of said primary blade being 14 mm, the distance from said hub with respect to said auxiliary blade being gradually increased from said leading edge of said trailing edge, an attaching angle of said upper auxiliary blade being 15° and an attaching angle of said lower auxiliary blade being 30°.

21. An axial flow fan having at least one auxiliary blade according to claim 8, wherein, three auxiliary blades are respectively at the same positions on each of the suction and pressure surfaces of four primary blades, and the length of said extended portion of each of said auxiliary blades is 3/10 of the width of said primary blades.

22. An axial flow fan having at least one auxiliary blade comprising:

a hub member rotatably supported and driven by a drive source;

a plurality of primary blades having a predetermined angle with respect to the rotational direction thereof and a predetermined width and height, said primary blades being radially provided on said hub member and each including a leading edge; and at least one auxiliary blade disposed on at least one of a suction and pressure surface of said primary blades, and extending beyond an end portion of a trailing edge of said primary blade, said auxiliary blade extending substantially within a predetermined length in a width direction of said primary blade on said surface thereof, a leading edge of said auxiliary blade being positioned closer to an axis of the fan than a trailing edge of said auxiliary blade and beginning at a position corresponding to or trailing the leading edge of said primary blade, whereby a radial flow is increased by said extending portion of said auxiliary blade and wherein, said axial flow fan is applied to a radiator fan which is provided between a radiator and an engine driving said radiator fan and which is surrounded by a throttled part of a shroud fixed to said radiator with an enlarged part thereof, the heights of said auxiliary blades on said suction and pressure surfaces being gradually increased from said leading edge to said trailing edge, an attaching angle of said uppermost auxiliary blade being smaller than that of said middle auxiliary blade and said attaching angle of said middle auxiliary blade being smaller than that of the lowermost auxiliary blade.

23. An axial flow fan having at least one auxiliary blade according to claim 8, wherein, at least two auxiliary blades are on each suction surface of a plurality of primary blades, the length of said extended portion of each of said auxiliary blades is 3/10 of the width of said primary blades, said upper auxiliary blade is positioned in the radially outermost portion of the respective one of said primary blades, and a projecting portion of an arcuate shape is provided extendingly from an end portion of a trailing edge of each of said primary blades a a reinforcing member for reinforcing said extended portion of said respective auxiliary blade, said projecting portion being integrally formed with said extended portion of said auxiliary blade.

24. An axial flow fan having at least one auxiliary blade comprising:

a hub member rotatably supported and driven by a drive source;

a plurality of primary blades having a predetermined angle with respect to the rotational direction thereof and a predetermined width and height, said primary blades being radially provided on said hub member;

at least one auxiliary blade disposed on at least one of a suction and pressure surface of said primary blades, and extending beyond an end portion of a trailing edge of said primary blade, said auxiliary blade extending substantially within a predetermined length in a width direction of said primary blade on said surface thereof, a leading edge of said auxiliary blade being positioned closer to an axis of the fan than a trailing edge of said auxiliary blade, whereby a radial flow is increased by said extending portion of said auxiliary blade, wherein at least two auxiliary blades are provided on each of said plurality of primary blades;

the distance between said two adjacent auxiliary blades at said leading edges thereof in the radial direction of said primary blade is larger than that at said trailing edges thereof, whereby said radial flow of said auxiliary blades is increased; and wherein at least two auxiliary blades are on each suction surface of a plurality of primary blades, the length of said extended portion of each of said auxiliary blades is 3/10 of the width of said primary blades, said upper auxiliary blade is positioned in the radially outermost portion of the respective one of said primary blades, and a projecting portion of an arcuate shape is provided extendingly from an end portion of a trailing edge of each of said primary blades as a reinforcing member for reinforcing said extended portion of said respective auxiliary blade, said projecting portion being integrally formed with said extended portion of said auxiliary blade;

said axial flow fan is applied to a radiator fan which is provided between a radiator and an engine driving said radiator fan and which is surrounded by a throttled part of a shroud fixed to said radiator with an enlarged part thereof, and said blades are interposed within said shroud in half axial width thereof, and the heights of said auxiliary blades are gradually increased from said leading edge to said trailing edge.

25. An axial flow fan having at least one auxiliary blade comprising:

a hub member rotatably supported and driven by a drive source;

a plurality of primary blades, including radially outwardly formed edge portions, having a predetermined angle with respect to the rotational direction thereof and a predetermined width and height, said primary blades being radially provided on said hub member; and at least one auxiliary blade disposed inwardly from the radially outward edge portion of said primary blade, disposed on at least one of a suction and pressure surface of said primary blades, and extending beyond an end portion of a trailing edge of said primary blade, said auxiliary blade extending substantially within a predetermined length in a width direction of said primary blade on said surface thereof, a leading edge of said auxiliary blade being positioned closer to an axis of the fan than a trailing edge of said auxiliary blade, whereby a radial flow is increased by said extending portion of said auxiliary blade.

26. An axial flow fan having at least one auxiliary blade comprising:

a hub member rotatably supported and driven by a drive source;

a plurality of primary blades having a predetermined angle with respect to the rotational direction thereof and a predetermined width and height, said primary blades being radially provided on said hub member; and at least one auxiliary blade disposed on at least one of a suction and pressure surface of said primary blades, and extending beyond an end portion of a trailing edge of said primary blade, said auxiliary blade extending substantially within a predetermined length and a width direction of said primary blade on said surface thereof, a leading edge of said auxiliary blade being positioned closer to an axis of the fan than a trailing edge of said auxiliary blade wherein the surfaces of said auxiliary blade are radially inwardly offset with respect to a line joining the leading edge of said auxiliary blade and the trailing edge of said auxiliary blade whereby a radial flow is increased by said extending portion of said auxiliary blade.

* * * * *